US007361866B2

(12) United States Patent
Chun

(10) Patent No.: US 7,361,866 B2
(45) **Date of Patent: *Apr. 22, 2008**

(54) COOKING APPARATUS USING BARCODE

(75) Inventor: Yun-Bong Chun, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 65 days.

This patent is subject to a terminal disclaimer.

(21) Appl. No.: 10/872,440

(22) Filed: Jun. 22, 2004

(65) Prior Publication Data

US 2005/0016996 A1 Jan. 27, 2005

(30) Foreign Application Priority Data

Jul. 22, 2003 (KR) ..... 10-2003-0050196
Apr. 9, 2004 (KR) ..... 10-2004-0024463

(51) Int. Cl.
*H05B 1/02* (2006.01)
*H05B 6/68* (2006.01)

(52) U.S. Cl. ..... 219/506; 219/714; 219/702; 99/325; 700/211

(58) Field of Classification Search ..... 219/702, 219/714, 506; 99/325, 451; 700/211
See application file for complete search history.

(56) References Cited

U.S. PATENT DOCUMENTS 5,321,232 A 6/1994 Ogle ..... 219/506
6,124,583 A 9/2000 Bowers ..... 219/714
2002/0059175 A1 5/2002 Nakano

FOREIGN PATENT DOCUMENTS

| | | | |
|---|---|---|---|
| GB | 2 249 388 | * | 5/1992 |
| JP | 56-136211 | | 3/1980 |
| JP | 56-29715 | * | 3/1981 |
| JP | 62-147223 | | 7/1987 |
| JP | 63-150139 | * | 6/1988 |
| JP | 1-285714 | | 11/1989 |
| JP | 2-110214 | | 4/1990 |
| JP | 4-356620 | | 12/1992 |
| JP | 2000-205569 | | 7/2000 |
| JP | U3076649 | | 1/2001 |
| JP | 2002-243161 | | 8/2002 |
| JP | 2002-332075 | | 11/2002 |

OTHER PUBLICATIONS

U.S. Appl. No. 11/362,921, filed Feb. 28, 2006, Kwang Keun Kim.

* cited by examiner

*Primary Examiner*—Philip H. Leung
(74) *Attorney, Agent, or Firm*—Staas & Halsey LLP

(57) ABSTRACT

A cooking apparatus using barcodes, including: a barcode reader which reads a barcode including cooking information recorded in the barcode; a cooking information calculator which analyzes the basic cooking information based on an analysis rule for analyzing the cooking information and calculating a final cooking condition based on the analyzed cooking information; and a controller which controls elements of the cooking apparatus to perform cooking so as to achieve the final cooking condition.

15 Claims, 17 Drawing Sheets

COOKING APPARATUS USING BARCODE

CROSS-REFERENCE TO RELATED APPLICATIONS

This application claims the benefit of Korean Application No. 2003-50196, filed Jul. 22, 2003, and Korean Application No. 2004-24463, filed Apr. 9, 2004, in the Korean Intellectual Property Office, the disclosures of which are incorporated herein by reference.

BACKGROUND OF THE INVENTION

1. Field of the Invention

The present invention relates to a cooking apparatus using barcodes, and more particularly, to a cooking apparatus using barcodes that reads a barcode attached to a package of food, thereby facilitating cooking of the food.

2. Description of the Related Art

Cooking apparatuses use various heat sources to cook food, and various different products according to heat sources are on the market. Among them is an electronic oven (also called a "microwave oven") which uses microwaves to heat food. A conventional electronic oven usually allows a user to manually input cooking information, such as cooking time, a cooking method, and an item to be cooked, through a key input unit mounted on a front panel of the electronic oven. However, since such a conventional electronic oven requires the user to manually input the cooking information, it is sometimes difficult and inconvenient for the user to set suitable cooking conditions.

A barcode reading electronic oven has been developed to overcome the aforementioned problem, which includes a barcode reader and cooks food according to cooking information read by the barcode reader. As shown in FIG. 1A, a general electronic oven with a barcode reader includes a main body 1, a door 2 provided on a front surface of the main body 1, and a front panel 3 provided on the right of the door 2.

The front panel 3 includes an embedded barcode reader 4 for reading barcodes, which is provided on the front panel 3 at an upper portion thereof, and a display unit 5 for displaying operating states of the electronic oven, which is provided on the front panel 3 below the barcode reader 4. A key input unit 6 including a plurality of input buttons is provided on the front panel 3 below the display unit 5. The key input unit 6 includes a start button for inputting a signal to start cooking, a barcode reading button for inputting a command signal to read barcodes, a cooking method setting button for setting a cooking method, a cooking time button for setting cooking time, a plurality of numeral buttons, and the like.

The general barcode reading electronic oven may employ, instead of an embedded barcode reader 4 as shown in FIG. 1A, an external barcode reader such as a CCD (Charge Coupled Display)-type barcode reader 7 as shown in FIG. 1B or a pen-type barcode reader (not shown) connected to the electronic oven via a cable.

In the related art, all information for cooking has been recorded in bars of a barcode as shown in FIG. 2. For example, in the case where cooking is performed in two stages (i.e., first and second stages), cooking information for performing the first stage and cooking information for performing the second stage are all recorded in a barcode.

The conventional electronic oven with the barcode reader reads a barcode provided on a package of food to set cooking conditions, and cooks the food according to the set cooking conditions.

However, the conventional electronic oven with the barcode reader only has a simple function, which is to analyze cooking information recorded in the barcode and perform cooking based on the analyzed cooking information. This requires complete cooking information to be recorded in the barcode. Thus, the conventional electronic oven with the barcode reader has a problem in that in order to record information of cooking, which is performed in a plurality of stages, in a barcode, complete cooking information for each of the stages must be recorded in the barcode. The conventional electronic oven also has a problem in that as cooking time increases, the number of barcode bits required to record information of the cooking time increases.

Electronic ovens with barcode readers may have different capabilities in reading barcodes and performing cooking. For example, the electronic ovens may have different output powers 1000 W and 1500 W, different cooking chamber capacities 20 L and 25 L, different possible cooking methods, etc. However, all of the electronic ovens cook food by reading barcodes in which the same cooking information is recorded, irrespective of their different cooking capabilities, which causes the food to be overcooked or undercooked.

SUMMARY OF THE INVENTION

Therefore, the present invention has been made in view of the above and/or other problems, and it is an aspect of the present invention to provide a cooking apparatus using barcodes, which has a function to calculate cooking conditions, wherein only a simple format of basic cooking information, as a basis for the calculation, is recorded in a barcode to be read by the cooking apparatus, thereby reducing the size of cooking information to be recorded in the barcode.

It is another aspect of the present invention to provide a cooking apparatus using barcodes, which is capable of automatically selecting a barcode suitable for the cooking apparatus from a plurality of barcodes in which different cooking information is recorded.

According to an aspect of the present invention, there is provided a cooking apparatus using barcodes, including: a barcode reader which reads a barcode including cooking information recorded in the barcode; a cooking information calculator which analyzes the basic cooking information based on an analysis rule for analyzing the cooking information and calculating a final cooking condition based on the analyzed cooking information; and a controller which controls elements of the cooking apparatus to perform cooking according to the final cooking condition.

According to an aspect of the present invention, there is provided a cooking apparatus using barcodes, including: a barcode reader which reads a barcode including cooking information recorded in the barcode; a controller which analyzes the cooking information based on the analysis rule and which obtains a final cooking condition based on the analyzed cooking information; and a driver which performs cooking so as to achieve the final cooking condition.

According to an aspect of the present invention, there is provided a cooking apparatus using barcodes, including: a barcode reader which reads a barcode including barcode information recorded in the barcode; a cooking information processor which analyzes the barcode information based on an analysis rule for analyzing barcode information, calculates final cooking information based on the data to be inputted by a user when the analyzed barcode information is intermediate cooking information, and maintains the analyzed barcode information when the analyzed barcode information is final cooking information; and a controller which controls elements of the cooking apparatus to perform cooking so as to achieve a state corresponding to the final cooking information.

According to an aspect of the present invention, there is provided a cooking apparatus using barcodes, including: a barcode reader which reads a barcode including barcode information recorded in the barcode; a controller which analyzes the barcode information based on an analysis rule for analyzing barcode information, calculates final cooking information based on the analyzed barcode information when the analyzed barcode information is intermediate cooking information, and maintains the analyzed barcode information when the analyzed barcode information is final cooking information; and a driver which controls elements of the apparatus to perform cooking so a to achieve a state corresponding to the final cooking information.

According to an aspect of the present invention, there is provided a cooking apparatus using barcodes, including: a barcode selector which selects a barcode to be read from a plurality of barcodes; a barcode reader which reads barcode information recorded in the selected barcode; a cooking information processor which analyzes the barcode information based on an analysis rule for analyzing barcode information, calculates final cooking information based on the data to be inputted by a user when the analyzed barcode information is intermediate cooking information, and maintains the analyzed barcode information when the analyzed barcode information is final cooking information; and a controller which controls elements of the cooking apparatus to perform cooking so as to achieve a state corresponding to the final cooking information.

According to yet another aspect of the present invention, there is provided a cooking apparatus using barcodes, including: a barcode selector which selects a barcode to be read from a plurality of barcodes; a barcode reader which reads basic cooking information recorded in the selected barcode; a cooking information calculator which analyzes the basic cooking information based on an analysis rule for analyzing the basic cooking information, and which calculates a final cooking condition based on the analyzed basic cooking information; and a controller which controls elements of the cooking apparatus to perform cooking so as to achieve a state corresponding to the final cooking condition.

According to yet another aspect of the present invention, there is provided a method of cooking using a cooking apparatus with a bar code reader, including: selecting a bar code set to be read from a plurality of bar code sets; reading cooking information contained in the selected bar code set by the bar code reader; interpreting the read cooking information based on stored interpreting information; determining whether the interpreted cooking information is intermediate cooking information or final cooking information; calculating final cooking information based on the data to be inputted by a user when the interpreted cooking information is intermediate cooking information; and cooking food in the microwave oven according to the final cooking information.

According to yet another aspect of the present invention, there is provided a method of cooking using barcodes to operate a cooking apparatus, including: checking whether a command signal to read barcode information has been input; reading bar code information when it is determined that a command signal has been input; cooking the item according to the set cooking conditions when it is determined that the cooking start signal has been input; analyzing the barcode information based on analysis rules; calculating final cooking conditions based on the barcode information after the analyzing; determining, after the calculating, whether a signal to start cooking has been input until the start cooking signal is determined to be input; and cooking the item so as to achieve a state corresponding to the final cooking conditions when determined that the cooking start signal has been input.

Additional and/or other aspects and advantages of the present invention will be set forth in part in the description which follows and, in part, will be obvious from the description, or may be learned by practice of the invention.

BRIEF DESCRIPTION OF THE DRAWINGS

These and/or other aspects and advantages of the present invention will become apparent and more readily appreciated from the following detailed description, taken in conjunction with the accompanying drawings of which.

DETAILED DESCRIPTION OF EMBODIMENTS

Figure 1A:
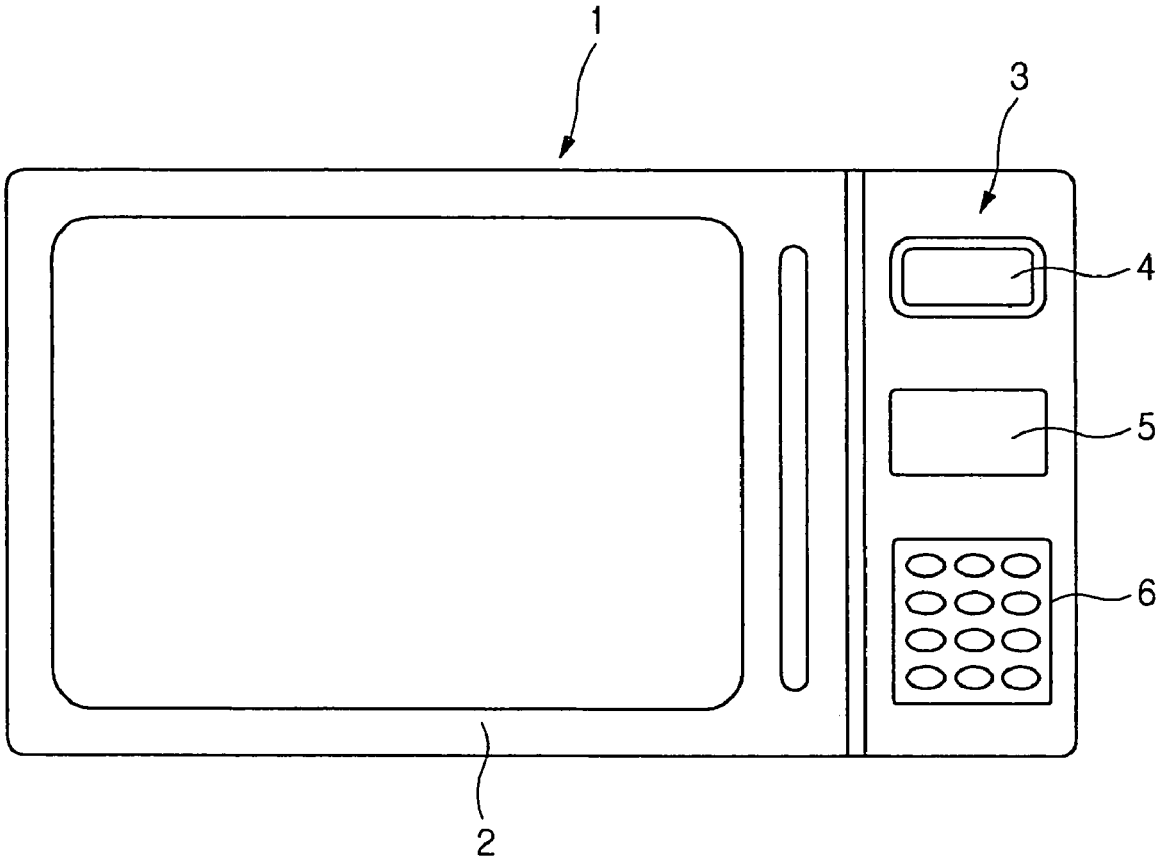
FIG. 1A PRIOR ART
FIG. 1A is a front view showing a prior art electronic oven including an embedded barcode reader.
Figure 1B:
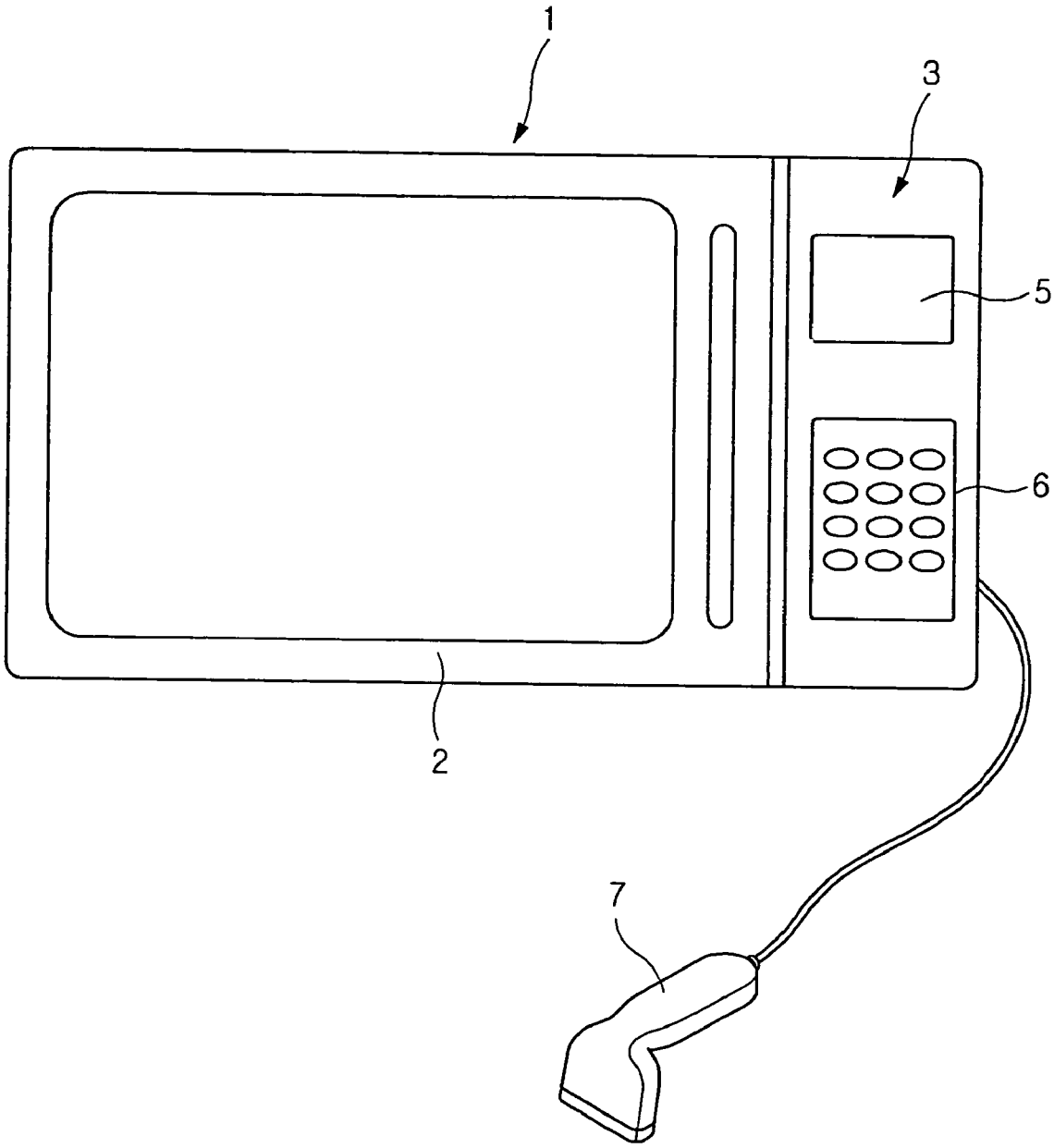
FIG. 1B PRIOR ART
FIG. 1B is a front view showing a prior art electronic oven including an external barcode reader.
Figure 2:
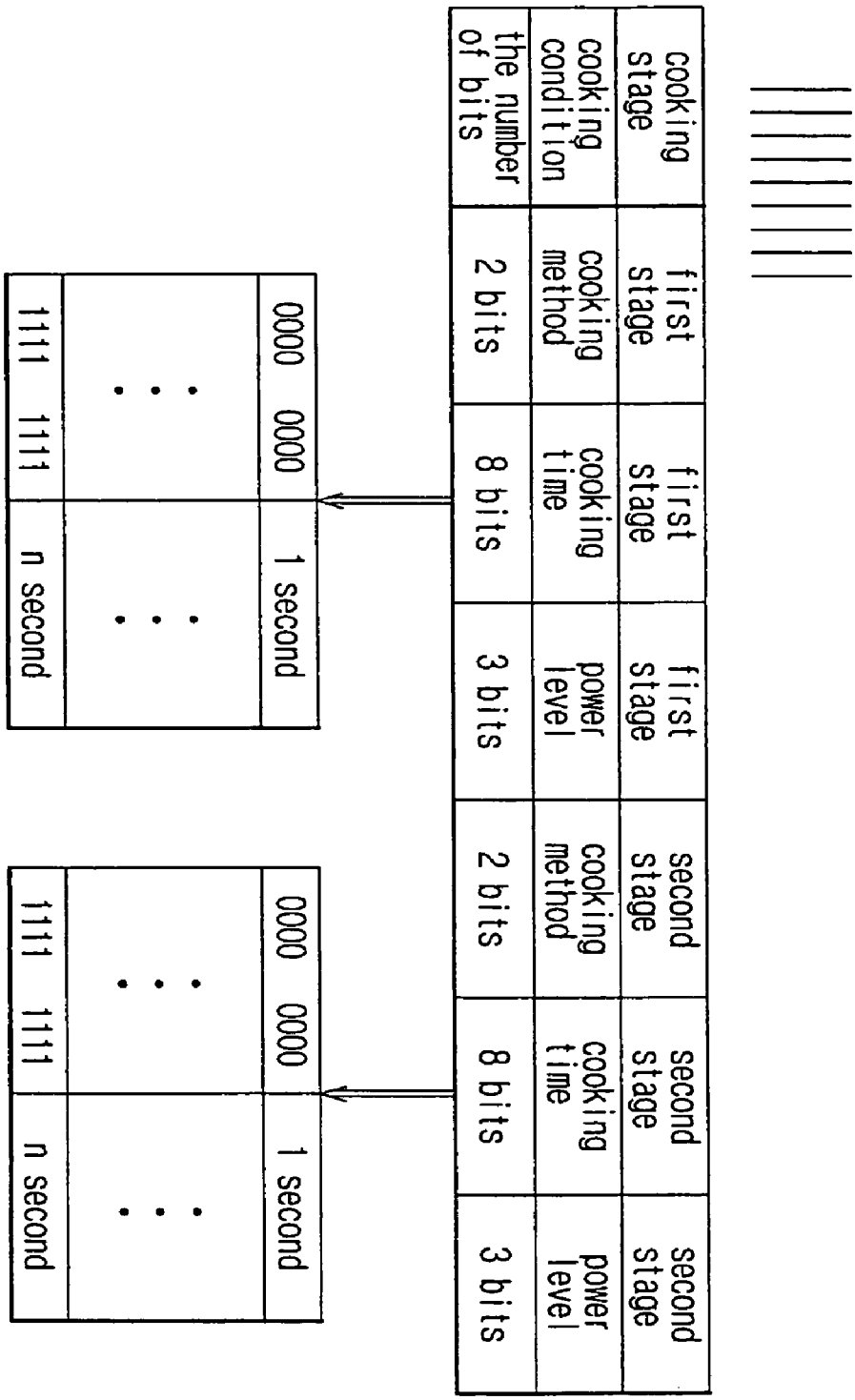
FIG. 2 PRIOR ART
FIG. 2 is a diagram showing a prior art barcode for cooking.

Reference will now be made in detail to embodiments of the present invention, examples of which are illustrated in the accompanying drawings, wherein like reference numerals refer to the like elements throughout. The embodiments are described below in order to explain the present invention by referring to the figures.

Figure 3:
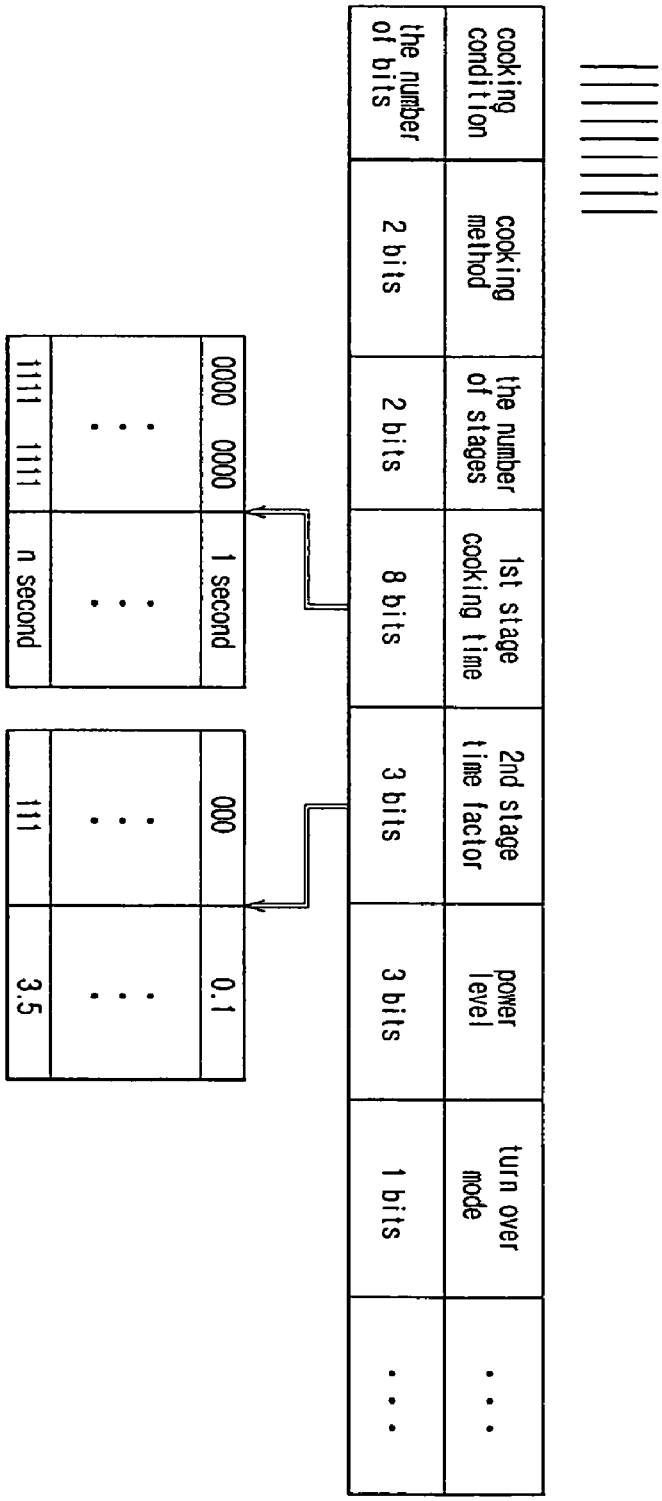
FIG. 3 is a diagram showing a barcode used in a first embodiment of the present invention.

According to a first embodiment of the present invention, all cooking information of each cooking stage is not recorded in a barcode used for an electronic oven as in the related art. Rather, basic cooking information for calculating final cooking conditions is recorded in the barcode as shown in FIG. 3. A barcode generally includes an ID of about 4 bits, which is an identification code indicating the property of information carried by the barcode (for example, indicating whether the information is food or cooking information). The basic cooking information is thus recorded in a bar or bars next to the barcode identification information.

The basic cooking information is cooking information as a basis for calculation of the final cooking conditions. For example, the basic cooking information includes a first stage cooking time, a stage time factor, etc., that will be described in detail below. The basic cooking information is a kind of barcode information that corresponds to each data stored in the barcode.

Figure 4A:
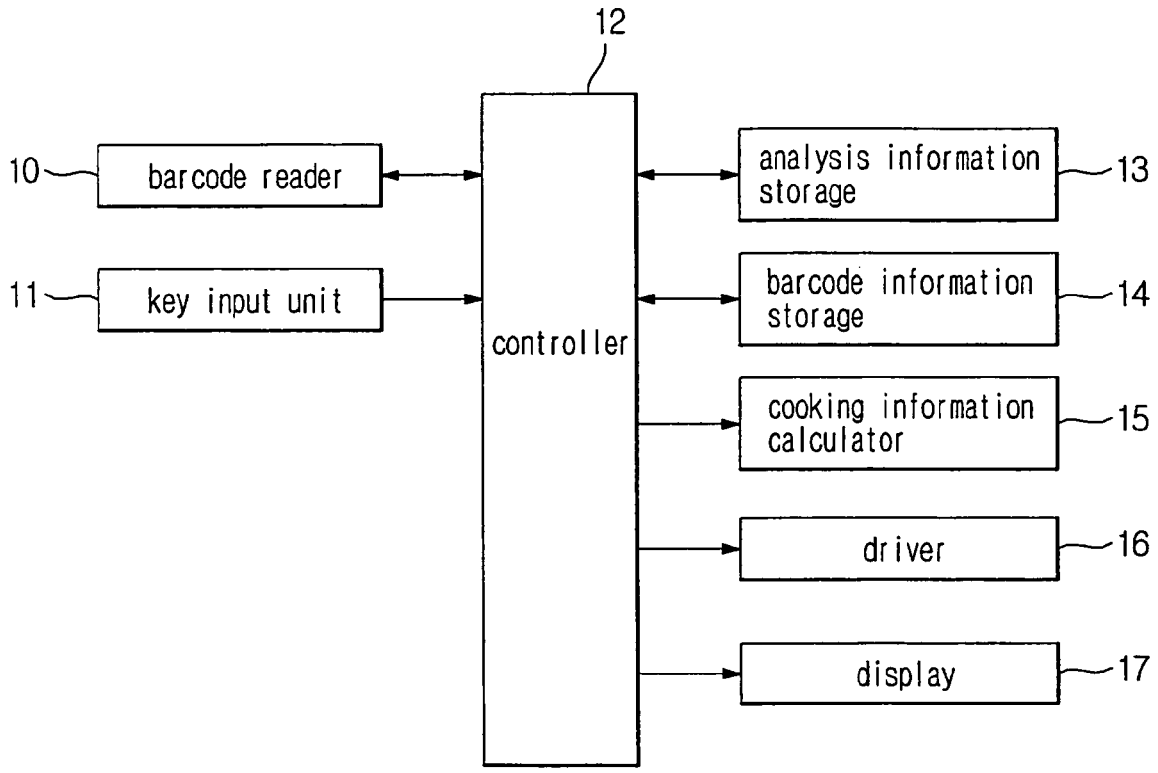
FIG. 4A is a block diagram showing the configuration of one electronic oven according to the first embodiment of the present invention.

As shown in FIG. 4A, an electronic oven according to the first embodiment of the present invention includes a barcode reader 10 for reading barcodes, a barcode information storage unit 14 for storing barcode information read by the barcode reader 10, an analysis information storage unit 13 for storing analysis rules for analyzing barcodes, a cooking information calculator 15 for analyzing barcode information based on the analysis rules and calculating final cooking conditions based on the analyzed barcode information (or basic cooking information), and a controller 12 for controlling overall operations of the electronic oven.

Figure 4B:
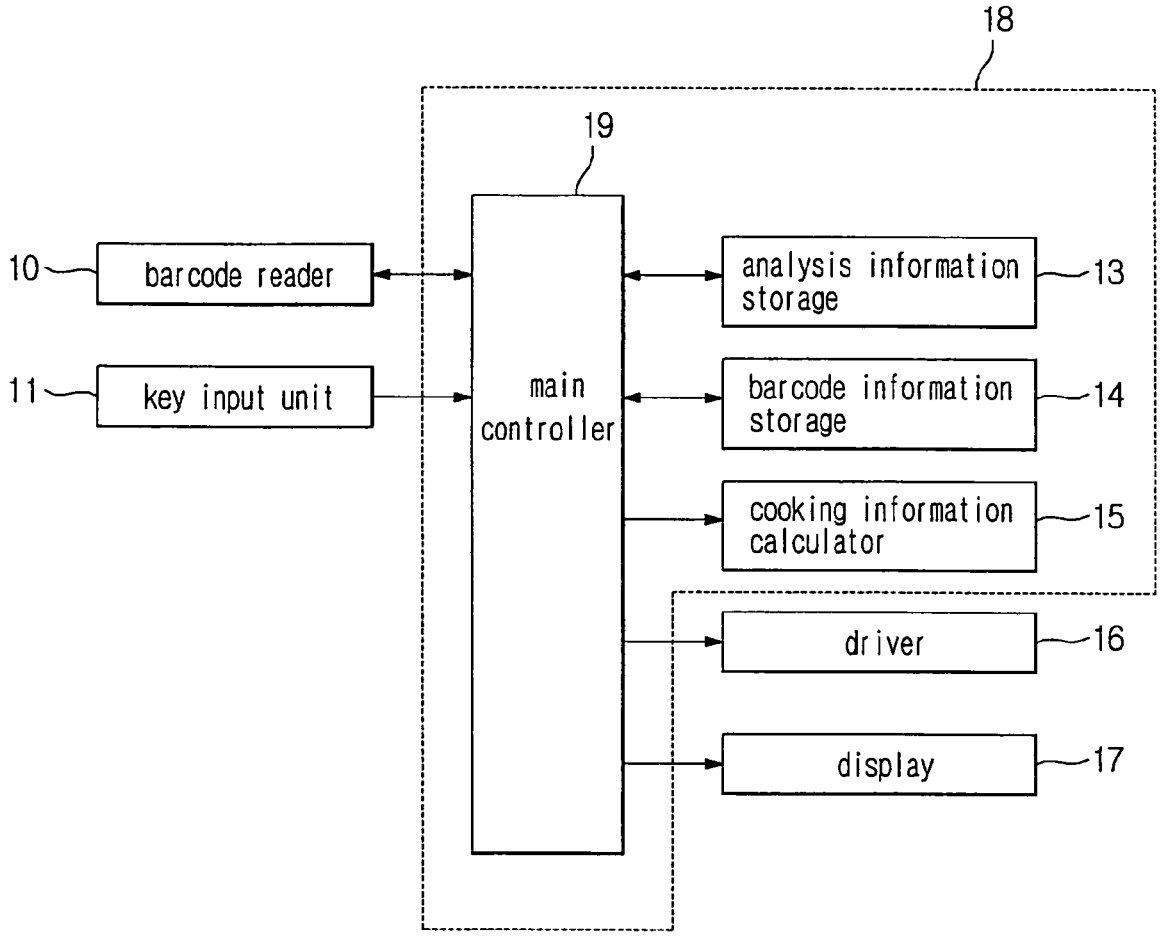
FIG. 4B is a block diagram showing the configuration of another electronic oven according to the first embodiment of the present invention, which includes a controller different from that of FIG. 4A.

The barcode information storage unit 14, the analysis information storage unit 13 and the cooking information calculator 15 may be provided externally as shown in FIG. 4A, but they may also be embedded in a controller 18 as shown in FIG. 4B, where a main controller 19 performs the same function as the controller 12 in FIG. 4A.

The electronic oven according to the first embodiment of the present invention further includes a key input unit 11 including a plurality of keys for inputting control commands, a driver 16 for driving a magnetron (not shown) or an electric heater (not shown) to perform cooking, and a display unit 17 for displaying states of the electronic oven.

The analysis information storage unit 13 stores information defining cooking conditions that are recorded in a barcode such as that shown in FIG. 3. The cooking conditions stored in the analysis information storage unit 13 include a cooking method, the number of stages, a first stage cooking time, an N-th stage time factor (N is a natural number(2, 3, 4, . . . ) greater than 1), a power level, a turn over mode, and convection temperature.

The barcode analysis rules are described with reference to FIGS. 3, 4A and 4B. The cooking method as a cooking condition indicates a method in which the electronic oven cooks food. For example, if 2-bit barcode information representing the cooking method is "00", it indicates a cooking method using microwaves; "01" indicates a grill cooking method using an electric heater; "10" indicates a toast/bake cooking method in which food is baked; and "11" indicates a convection cooking method using the combination of the microwaves, the electric heater and a convection pan (not shown).

TABLE 1

| The number of bits | 2 bits | | 8 bits | | 3 bits | |
|---|---|---|---|---|---|---|
| cooking conditions | The number of stages | | 1st stage cooking time | | 2nd stage time factor | |
| cooking details | 00 | 1 stage | 0000 0000 | 1 second | 000 | 0.1 |
| | . . . | | . . . | | . . . | |
| | 11 | 4 stages | 1111 1111 | 2500 seconds | 111 | 3.5 |

In Table 1, the number of stages indicates the number of cooking stages in which cooking is performed. For example, if 2-bit barcode information in which the number of stages is recorded is "00", it indicates that the number of stages is 1; and "01" indicates that the number of stages is 2. If the number of stages is 2, the cooking is performed in two stages (i.e., first and second stages).

The first stage cooking time indicates the period of time of a first stage of cooking when the cooking is performed in a plurality of stages. For example, in the case where an 8-bit recording field in a barcode is allocated to record the first stage cooking time, if the 8 bits are read as "1000 0000", the first stage cooking time can be analyzed as 1280 seconds.

The stage time factor is defined to set the cooking time of a stage other than the first stage. The cooking time of a stage other than the first stage is not directly recorded in the barcode but a stage time factor representing the ratio (or functional relationship) of the cooking time of the stage to the first stage cooking time is recorded in the barcode. Accordingly, the respective cooking times of the stages other than the first stage are calculated by the following equation:

$N$-th stage cooking time=1st stage cooking time×$N$-th stage time factor, where $N$ is a natural number(2, 3, 4, . . . ) greater than 1.

For example, a 3-bit recording space in the barcode is allocated to record the second stage time factor, and if the 3 bits are read as "000", the second stage time factor is analyzed as 0.1; if the 3 bits are read as "100", the second stage time factor is analyzed as 1.0; and if the 3 bits are read as "101", the second stage time factor is analyzed as 1.5. In the case where the first stage cooking time is 200 seconds, if the 3 bits are read as "101", indicating that the second stage time factor is 1.5, the second stage cooking time is 300 seconds, which is 1.5 times the first stage cooking time (200 seconds).

Here, it is to be understood that the second stage time has a functional relationship with the first stage time such that the second stage time is the product of the first stage time and the second stage time factor.

A large number of barcode bits are required to directly record respective cooking times of stages in the barcode. However, if stage time factors are employed as described above, it is possible to record the same amount of cooking information in the barcode while using a smaller recording space.

The power level is a cooking condition for determining the level of power to be supplied to the electronic oven during cooking. If the cooking is performed in a plurality of stages, respective power levels are set for each of the stages.

The turn over mode is a cooking condition that is set to indicate whether it is necessary to turn food over after a stage is completed and before the next stage is begun. For example, if 1-bit barcode information allocated in the barcode for recording the turn over mode is read as "0", it indicates that there is no need to turn the food over; and if it is read as "1", it indicates that it is necessary to turn the food over.

The convection temperature is a cooking condition defined to set the temperature in the cooking chamber of the electronic oven when cooking is performed by convection. Convection is one of a plurality of cooking methods the electronic oven may use.

The cooking information calculator 15 analyzes read barcode information based on the analysis rules stored in the analysis information storage unit 13. For example, if a plurality of barcode information recorded in a barcode is a cooking method, the number of stages, a first stage cooking time, a stage time factor, a power level, a turn over mode and a convection temperature, the cooking information calculator 15 uses the analysis rules to analyze the cooking method, the number of stages, the first stage cooking time, the stage time factor, the power level, the turn over mode and the convection temperature of food to be cooked.

If the basic cooking information is analyzed, the cooking information calculator 15 calculates final cooking conditions based on the analyzed basic cooking information. For example, if the first stage cooking time is 200 seconds, the number of stages is 2 and the second stage time factor is 0.5, the cooking information calculator 15 calculates the second stage cooking time (100 seconds) by multiplying the first stage cooking time (200 seconds) by the second stage time factor (0.5).

Figure 5:
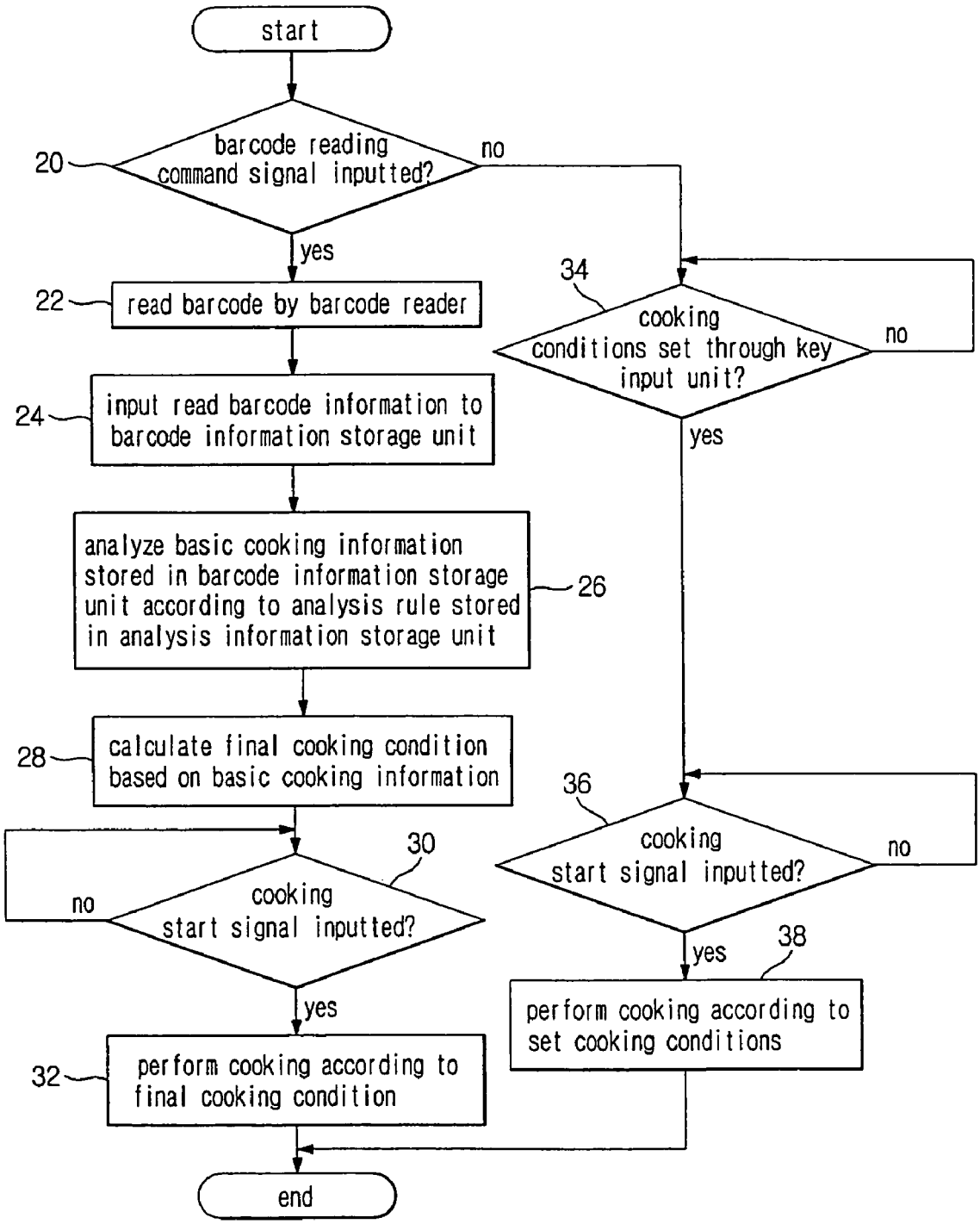
FIG. 5 is a flow chart showing a method for operating the electronic oven shown in FIGS. 4A and 4B.

A description will now be given of how the electronic oven using barcodes operates to cook food according to the first embodiment of the present invention, with reference to FIG. 5. A user can select whether the electronic oven, including the barcode reading function for cooking, performs cooking by reading a barcode or based on cooking conditions that the user sets through the key input unit 11. To determine whether to perform cooking based on barcode information or based on the cooking conditions input through the key input unit 11, the controller 12 checks whether a command signal to read barcodes has been input (operation 20). If the barcode reading command signal has been input, the controller 12 transmits a corresponding control signal to the barcode reader 10, allowing the barcode reader 10 to be ready to read barcodes. If the user brings a package of food, on which a barcode is printed, near the barcode reader 10 while the barcode reader 10 is ready to read barcodes, the barcode reader 10 reads the barcode printed on the package (operation 22).

If no barcode reading command signal is input at operation 20, the controller 12 determines whether cooking conditions have been set through the buttons of the key input unit 11 (operation 34). If the cooking conditions have been set through the key input unit 11, the controller 12 determines whether a signal to start cooking has been input (operation 36). If no cooking start signal is input, the controller 12 repeats the determination of operation 36, and if the cooking start signal has been input, the controller 12 performs cooking according to the set cooking conditions (operation 38).

The barcode information read at operation 22 is input to the barcode information storage unit 14 (operation 24). After the barcode information is input to the barcode information storage unit 14, the cooking information calculator 15 analyzes the barcode information stored in the barcode information storage unit 14 based on the analysis rules stored in the analysis information storage unit 13 (operation 26).

After analyzing the barcode information, the cooking information calculator 15 calculates final cooking conditions based on the barcode information that is basic cooking information (operation 28).

After calculating the final cooking conditions, the controller 12 determines whether a signal to start cooking has been input (operation 30). If no cooking start signal is input, the controller 12 repeats the determination as to whether the cooking start signal has been input (30). If the cooking start signal has been input, a magnetron or an electric heater is driven to perform cooking according to the final cooking conditions (operation 32).

Figure 6:
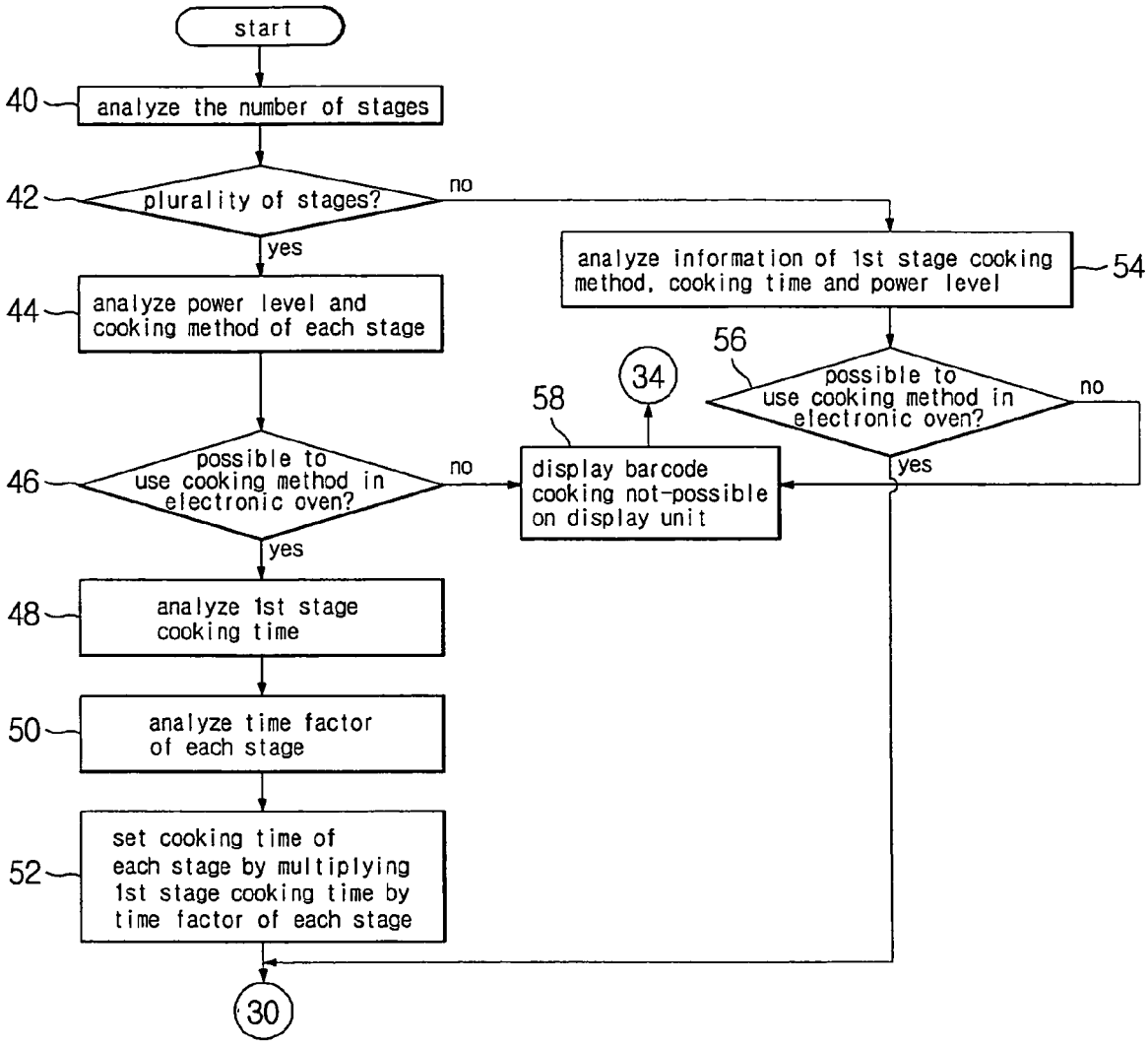
FIG. 6 is a flow chart showing in detail the steps of analyzing basic cooking information and calculating final cooking conditions in the method of FIG. 5.

A description will now be given of the steps of analyzing the barcode information and calculating the final cooking condition in the method of FIG. 5, with reference to FIG. 6. First, the number of stages in the read barcode information is analyzed to determine the number of cooking stages in which cooking is performed (operation 40). After analyzing the number of stages, it is determined whether the number of stages is greater than 1 (operation 42). If the number of stages is greater than 1, a power level and a cooking method of each of the stages are analyzed (44). If the cooking method of each of the stages is analyzed, the controller 12 determines whether the electronic oven can use the analyzed cooking method (operation 46). If the electronic oven cannot use the analyzed cooking method, the display unit 17 displays that the barcode cooking is not possible (operation 58). Then, the procedure moves to operation 34 of FIG. 5.

If the electronic oven can use the analyzed cooking method, the first stage cooking time and respective time factors of stages other than the first stage are analyzed (operations 48 and 50). If the first stage cooking time and the respective time factors of the stages are analyzed, the cooking information calculator 15 multiplies the first stage cooking time by the respective time factors of the stages to calculate respective cooking times of the stages other than the first stage (operation 52).

If the number of stages is 1 at operation 42, information of a cooking time, a cooking method and a power level of the first stage is analyzed (operation 54). If the cooking method is analyzed, it is determined whether the electronic oven can use the analyzed cooking method (56). If the electronic oven cannot use the analyzed cooking method, the above operation 58 is performed. If the electronic oven can use the analyzed cooking method, the above operation 30 is performed.

Although the first embodiment has been described in a case where the electronic oven stores the read barcode information in the barcode information storage unit 14, the read barcode information can also be analyzed directly without being stored separately.

While the cooking information calculator 15 performs the analysis of the basic cooking information and the calculation of the final cooking conditions in the electronic oven shown in FIG. 4A, the controller 12 performs the analysis and calculation in the electronic oven shown in FIG. 4B.

Although the first embodiment has been described with reference to a final cooking condition calculation method which uses respective time factors of stages other than the first stage to calculate respective cooking times of the stages, the same calculation method can be applied to calculate other cooking conditions (for example, respective temperature factors of stages other than the first stage may be used to calculate respective cooking temperatures of the stages).

Figure 7:
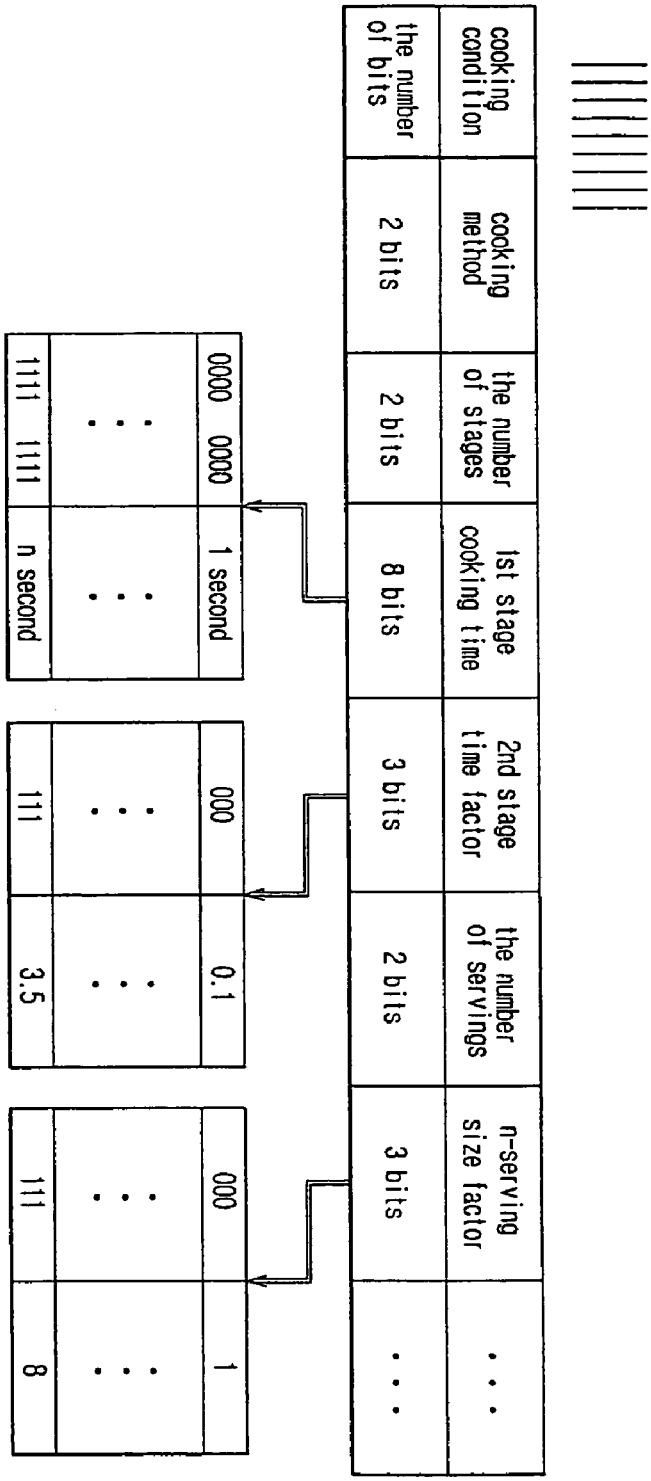
FIG. 7 is a diagram showing a barcode used in a second embodiment of the present invention.

A description will now be given of an electronic oven using barcodes according to a second embodiment of the present invention with reference to FIGS. 7, 8A and 8B. In these figures, the same or similar elements as those of FIGS. 3, 4A and 4B are denoted by the same reference numerals. As shown in FIG. 7, a barcode used for the electronic oven according to the second embodiment of the present invention further records information of a serving size factor and the number of servings, in addition to the barcode information recorded in the barcode as shown in FIG. 3.

Figure 8A:
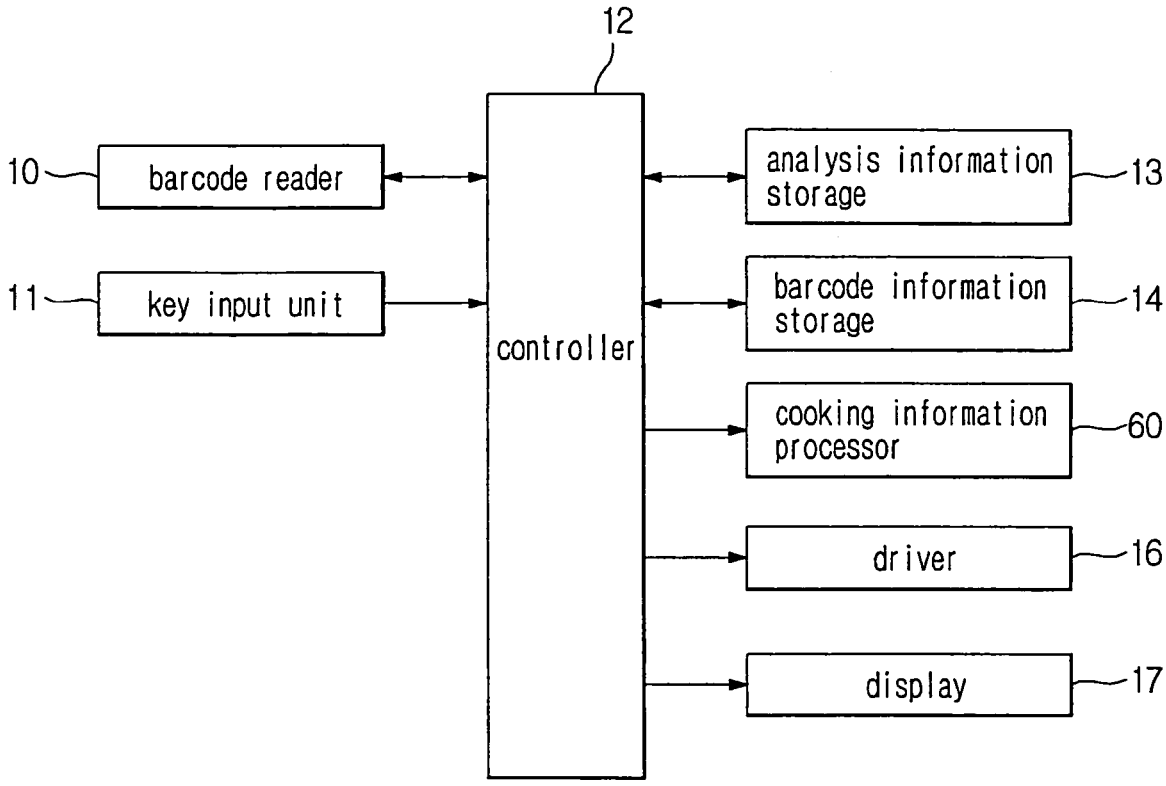
FIG. 8A is a block diagram showing the configuration of one electronic oven according to the second embodiment of the present invention.

As shown in FIG. 8A, the electronic oven according to the second embodiment of the present invention replaces the cooking information calculator 15 in the electronic oven shown in FIG. 4A with a cooking information processor 60. A barcode reader 10, a key input unit 11, a driver 16, a display unit 17, a barcode information storage unit 14 and a controller 12 in the second embodiment as shown in FIG. 8A are substantially the same as those in the first embodiment as shown in FIG. 4A, and a description thereof will thus be omitted.

Figure 8B:
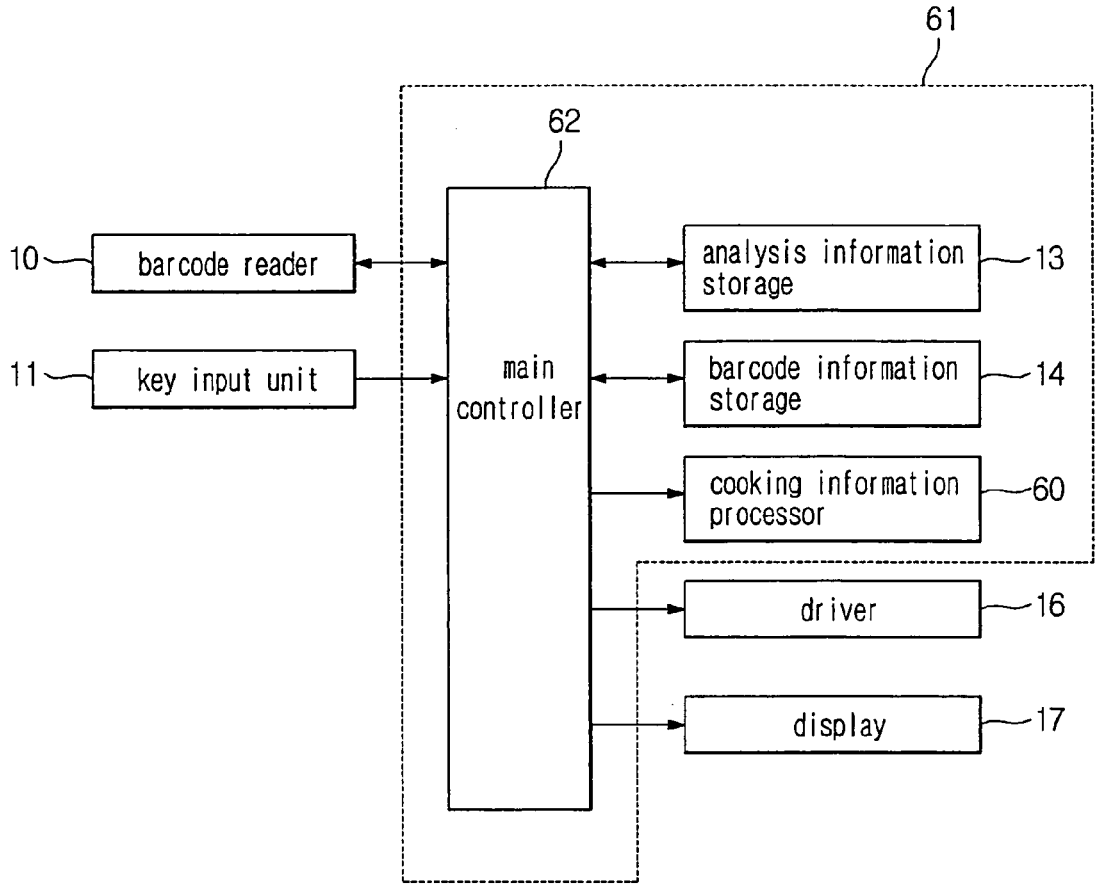
FIG. 8B is a block diagram showing the configuration of another electronic oven according to the second embodiment of the present invention, which includes a controller different from that of FIG. 8A.

The barcode information storage unit 14, the analysis information storage unit 13 and the cooking information processor 60 in the second embodiment may be provided externally as shown in FIG. 8A, but they may also be embedded in a controller 61 as shown in FIG. 8B, where a main controller 62 performs the same function as the controller 12 in FIG. 8A.

An analysis information storage unit 13 in the second embodiment stores information defining cooking conditions as in the first embodiment. The cooking conditions stored in the analysis information storage unit 13 include a cooking method, the number of servings, a first stage cooking time, a serving size factor, a power level, a turn over mode, and convection temperature. The cooking conditions, other than the number of servings and the serving size factor, are substantially the same as those in the first embodiment and further description thereof will thus be omitted.

TABLE 2

| The number of bits | 2 bits | | 3 bits | |
|---|---|---|---|---|
| cooking conditions | The number of servings | | N-serving size factor | |
| cooking details | 00 | 1 serving | 000 | 0.1 |
| | . . . | | . . . | |
| | 11 | 4 servings | 111 | 1.6 |

Table 2, the number of servings as a cooking condition recorded in the barcode indicates the number of servings corresponding to the quantity of an item to be cooked. For example, if 2 bits in the barcode, allocated to record the number of servings, are read as "00", the number of servings is analyzed as 1; and if the 2 bits are "01", the number of servings is analyzed as 2.

The serving size factor is defined to set a longer cooking time for an increased number of servings with a smaller number of barcode bits. A cooking time of each stage for more than one serving is recorded in the barcode using a serving size factor indicating the ratio of the cooking time of each stage for more than one serving to a cooking time of each stage for one serving. Accordingly, the cooking time of each stage for more than one serving is calculated by the following equation:

Respective cooking times of stages for $N$ servings=
(1st stage cooking time×$N$-serving size factor),
(2nd stage cooking time×$N$-serving size factor),
. . . , where N is a natural number (2, 3, 4, . . . ) greater than 1; and the 2nd stage cooking time is the product of the 1st stage cooking time and the 2nd stage time factor.

For example, if a first stage cooking time and a second stage cooking time for one serving are 200 and 100 seconds, respectively, and a 2-serving size factor is set to 1.2, then a first stage cooking time and a second stage cooking time for two servings, as final cooking conditions, are 240 and 120 seconds, respectively. Here, it is understood that the cooking time of each stage for two servings has a functional relationship with the cooking time of each stage for one serving such that the cooking time of each stage for two servings is the product of the cooking time of each stage for one serving and the 2-serving size factor which is a serving size factor corresponding to two servings.

Alternatively, a serving size factor may be defined as the ratio of a cooking time of each stage for a smaller number of servings than a specified number of servings to a cooking time of each stage for the specified number of servings, so that the cooking time of each stage for the smaller number of servings can be represented by a serving size factor corresponding to the smaller number of servings (i.e., by the ratio of the cooking time of each stage for the smaller number of servings to the cooking time of each stage for the specified number of servings). For example, if a first stage cooking time and a second stage cooking time for two servings are 200 and 100 seconds, respectively, and a serving size factor corresponding to one serving is 0.7, then a first stage cooking time and a second stage cooking time for one serving are 140 and 70 seconds, respectively.

Two or more servings require a long cooking time, compared to one serving. To record the longer cooking time directly in the barcode, a large number of barcode bits must be used, increasing the recording space thereof. However, if the serving size factor is employed as described above, it is possible to record the same amount of cooking information in the barcode while using a smaller recording space.

Although the second embodiment has been described with reference to a cooking condition calculation rule which uses the serving size factor to calculate the cooking time, the same calculation rule can be applied to calculate other cooking conditions such as cooking temperature.

The cooking information processor 60 analyzes the barcode information based on analysis rules stored in the analysis information storage unit 13. If the analyzed barcode information is intermediate cooking information, the analyzed barcode information is used to calculate final cooking information. On the other hand, if the analyzed barcode information is final cooking information, the final cooking information is maintained without alteration.

The intermediate cooking information is, for example, firstly analyzed cooking information that is required to be converted. For example, if the analyzed barcode information indicates that the number of servings is 3, it is necessary to change a cooking condition, initially set to be suitable for one saving, to a cooking condition suitable for 3 servings, and thus the initially set cooking condition is intermediate cooking information. On the other hand, the final cooking information is cooking information that is suitable for cooking food and thus does not require conversion.

If the analyzed barcode information is intermediate cooking information, the cooking information processor 60 performs calculation for conversion of the intermediate cooking information. For example, if the barcode information analyzed by the cooking information processor 60 indicates that the number of servings is 2, the cooking information processor 60 converts a cooking time of each stage by multiplying the cooking time of each stage by a serving size factor corresponding to two servings.

Figure 9:
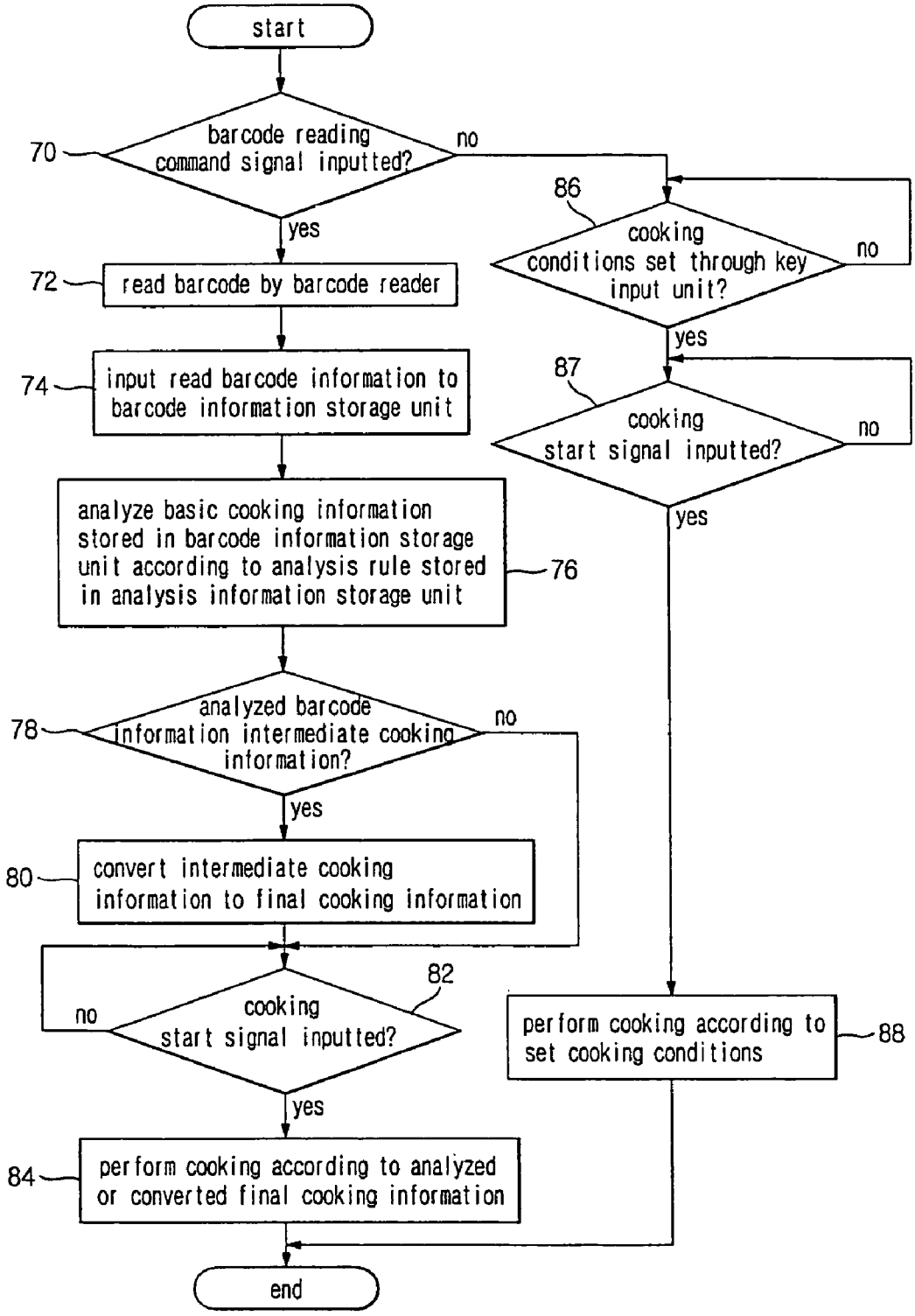
FIG. 9 is a flow chart showing a method for operating the electronic oven shown in FIGS. 8A and 8B.

A description will now be given of how the electronic oven using barcodes operates to cook food according to the second embodiment of the present invention, with reference to FIG. 9. To determine whether to perform cooking based on barcode information or based on cooking conditions set through the key input unit 11, the controller 12 checks whether a command signal to read barcodes has been input (operation 70). If the barcode reading command signal has been input, the controller 12 transmits a corresponding control signal to the barcode reader 10, allowing the barcode reader 10 to be ready to read barcodes. If the user brings a package of food with a barcode printed thereon near the barcode reader 10 while the barcode reader 10 is ready to read barcodes, the barcode reader 10 reads the barcode (operation 72).

If no barcode reading command signal is input at operation 70, the controller 12 determines whether cooking conditions have been set through the buttons of the key input unit 11 (operation 86). If the cooking conditions have been set through the key input unit 11, the controller 12 determines whether a signal to start cooking has been input (operation 87). If no cooking start signal is input, the controller 12 repeats the determination of operation 87, and if the cooking start signal has been input, cooking is performed according to the set cooking conditions (operation 88).

After the barcode information is read by the barcode reader 10, the read barcode information is input to the barcode information storage unit 14 (operation 74). After the barcode information is input to the barcode information storage unit 14, the cooking information processor 60 analyzes the barcode information stored in the barcode information storage unit 14 based on the analysis rules stored in the analysis information storage unit 13 (operation 76).

Then, the cooking information processor 60 determines whether the analyzed barcode information is intermediate cooking information (operation 78). If the analyzed barcode information is intermediate cooking information, the intermediate cooking information is converted to final cooking information using a corresponding serving size factor (operation 80). If the analyzed barcode information is final cooking information, operation 82 is performed as described below.

After setting the final cooking conditions, the controller 12 determines whether a signal to start cooking has been input (operation 82). If no cooking start signal is input, the controller 12 repeats the determination of operation 82. If the cooking start signal has been input, a magnetron or an electric heater is driven to perform cooking according to the final cooking conditions (operation 84).

Figure 10:
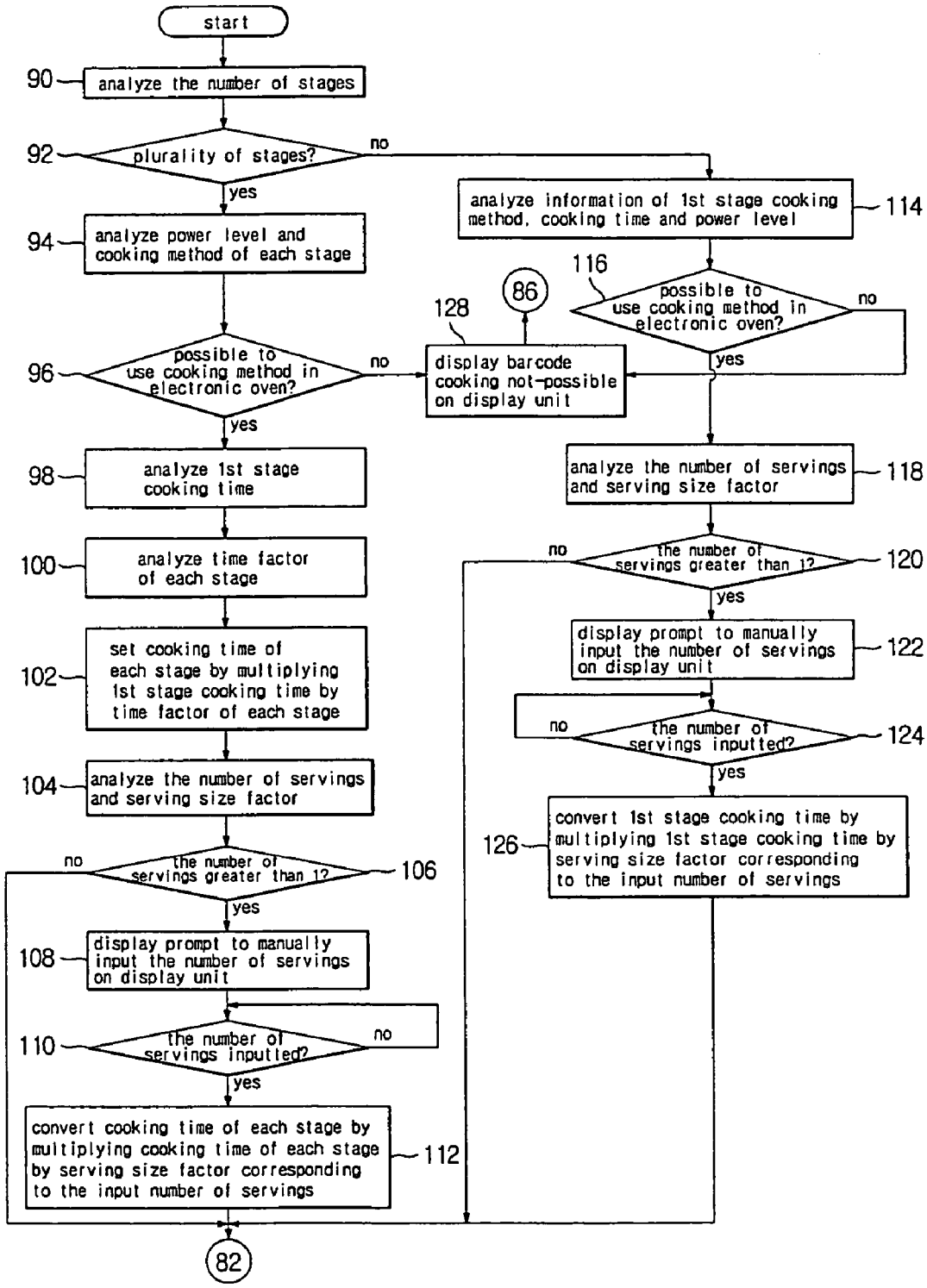
FIG. 10 is a flow chart showing in detail the steps of analyzing barcode information and calculating final cooking information in the method of FIG. 9.

A description will now be given of the operations of analyzing the barcode information and calculating the final cooking condition in the method of FIG. 9, with reference to FIG. 10. Operations 90 to 102 and steps 114 and 116 of FIG. 10 according to the second embodiment are substantially the same as operations 40 to 52 and operations 54 and 56 of FIG. 6 according to the first embodiment, and a description thereof will thus be omitted. However, the second embodiment differs from the second embodiment in that the barcode information is analyzed by the cooking information processor 60.

After operation 102 is performed, the cooking information processor 60 analyzes cooking information regarding the number of servings and a serving size factor (operation 104). It is then determined whether the analyzed number of servings is greater than 1 (operation 106).

If the analyzed number of servings is not greater than 1, the above operation 82 is performed. If the analyzed number of servings is greater than 1, the display unit 17 displays a prompt asking the user to manually input the number of servings (through the key input unit 11) (operation 108). The reason for the manual input of the number of servings is that the number of servings and the serving size factor set under the assumption that the entirety of a packaged item is cooked may not be suitable for the case where the packaged item is partly cooked. For this reason, the electronic oven allows the user to manually set different cooking conditions when the packaged item is partly cooked from those when the packaged item is entirely cooked.

Without the manual input of the number of servings, the electronic oven can also perform cooking according to cooking times that are set by multiplying respective cooking times of stages by a serving size factor corresponding to the analyzed number of servings recorded in the barcode. Further, instead of recording the number of servings in a barcode when the barcode is initially printed, respective cooking times of stages may be multiplied by a serving size factor corresponding to the number of servings input through the key input unit 15, after storing the serving size factor in the analysis information storage unit 13, so as to reset the respective cooking times of stages.

In the case where a plurality of items are separately packaged in a package and barcodes for cooking are printed on respective packages of the items, it is possible to cook a specific item, as a part of the plurality of items, by reading a barcode printed on a package of the specific item without the need to manually input the number of servings as in the above case.

The cooking information processor 60 determines whether the number of servings has been input through the key input unit 11 (operation 110). If the number of servings has been input, the cooking information processor 60 multiplies a cooking time of each stage by a serving size factor corresponding to the input number of servings so as to convert the cooking time of each stage, according to the analysis rules stored in the analysis information storage unit 13 (operation 112).

On the other hand, if the number of stages is 1 at operation 92, information of a cooking time, a cooking method and a power level of the first stage is analyzed (operation 114). If the cooking method is analyzed, it is determined whether the electronic oven can use the analyzed cooking method (operation 116). If the electronic oven cannot use the analyzed cooking method, operation 128 is performed. If the electronic oven can use the analyzed cooking method, the number of servings and the serving size factor are analyzed (operation 118). Next, the cooking information processor 60 determines whether the number of servings is greater than 1 (operation 120). If the number of servings is not greater than 1, step 82 is performed, and if the number of servings is greater than 1, the display unit 17 displays a prompt asking the user to input the number of servings through the key input unit 11 (operation 122). The cooking information processor 60 determines whether the number of servings has been input through the key input unit 11 (operation 124). If the number of servings has been input, the cooking information processor 60 multiplies a first stage cooking time by a serving size factor corresponding to the input number of servings to convert the first stage cooking time (operation 126).

Although the second embodiment has been described in a case where the electronic oven stores the read barcode information in the barcode information storage unit 14, the read barcode information can also be analyzed directly without being stored separately.

While the cooking information processor 60 performs the analysis of the basic cooking information and the calculation of the final cooking conditions in the electronic oven shown in FIG. 8A, the controller 12 performs the analysis and calculation in the electronic oven shown in FIG. 8B.

Figure 11:
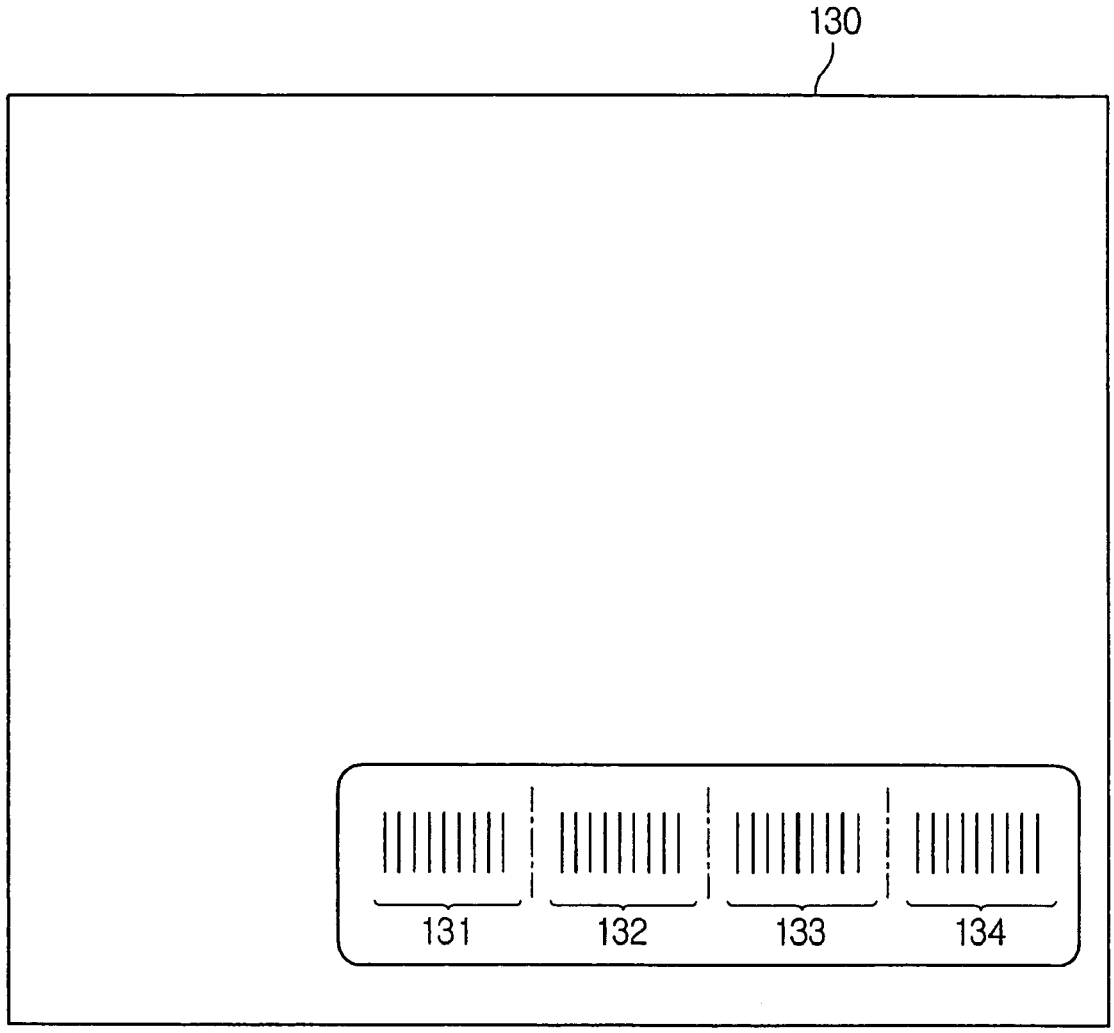
FIG. 11 is a diagram showing a plurality of barcodes used in a third embodiment of the present invention.

A description will now be given of barcodes used for an electronic oven according to a third embodiment of the present invention. As shown in FIG. 11, a plurality of barcodes 131, 132, 133 and 134, used for the electronic oven according to the third embodiment of the present invention, are horizontally arranged in a row on a food package 130 at a portion thereof. Each of the barcodes 131, 132, 133 and 134 is comprised of a number of black bars, and the widths and arrangement of the black bars of a barcode vary depending on information contained in the barcode.

The barcodes 131, 132, 133 and 134 may be arranged not only in a row but also in other various forms. However, it is also advantageous that the barcodes 131, 132, 133 and 134 be arranged adjacent to each other. This arrangement allows the user to bring all of the plurality of barcodes near the barcode reader, so as to automatically read one of the barcodes suitable for the electronic oven in single reading. This avoids the need for the user to find a suitable barcode to be read, which is necessary if the plurality of barcodes are provided separately according to capacities of the electronic oven and the types of the barcodes.

Different cooking conditions depending on capacities of the electronic oven may be recorded in the plurality of barcodes 131, 132, 133 and 134. For example, the first barcode 131 contains a cooking condition suitable for a cooking chamber capacity of 20 L, and the second barcode 132 contains a cooking condition suitable for a cooking chamber capacity of 25 L. The reason for providing the plurality of barcodes 131, 132, 133 and 134, in which different cooking conditions according to capacities of the cooking chamber are recorded, is that optimal cooking conditions such as a cooking time or a power level may vary even for the same item as the cooking chamber capacity of the electronic oven varies.

The plurality of barcodes 131, 132, 133 and 134 do not need to be the same type and they may have different formats or configurations. When compared to use of the same type of barcodes, the use of various types of barcodes increases the number of types of electronic ovens capable of using the barcodes, improving the applicability of the barcodes.

Figure 12A:
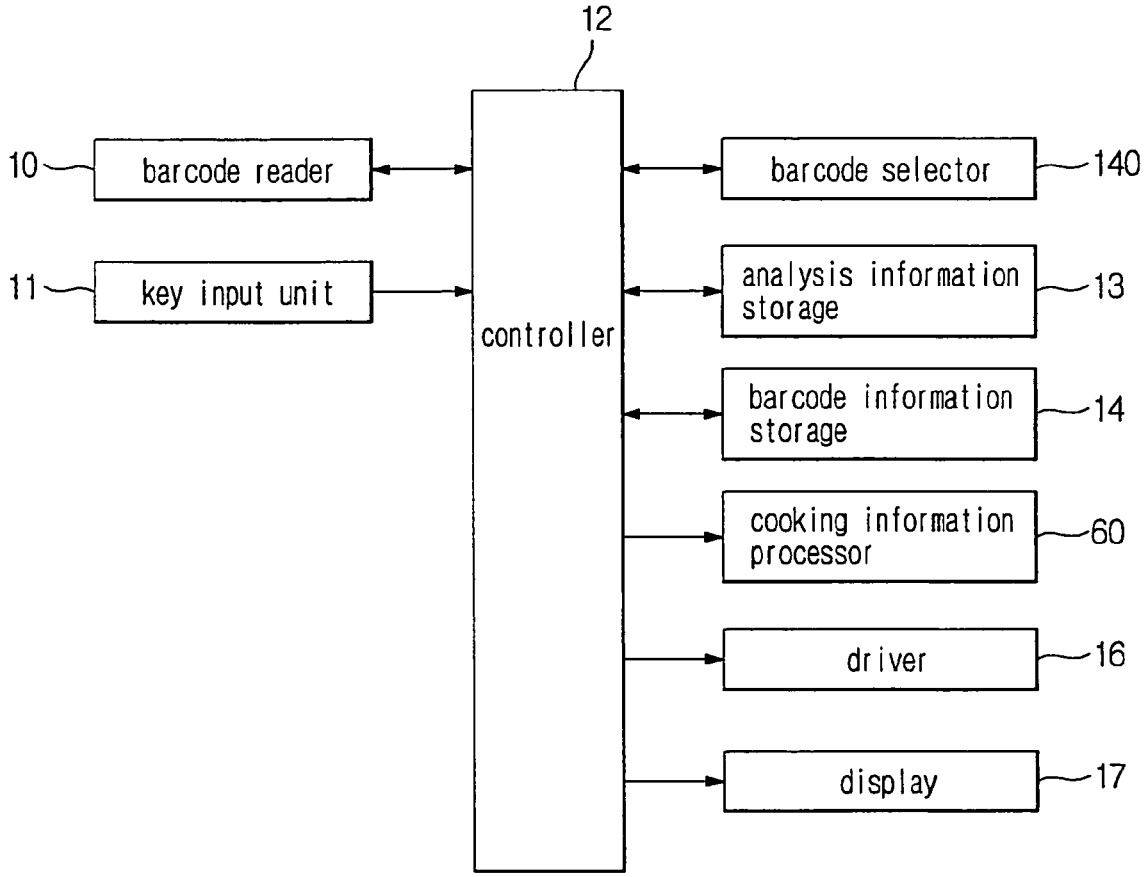
FIG. 12A is a block diagram showing the configuration of one electronic oven according to the third embodiment of the present invention.
Figure 12B:
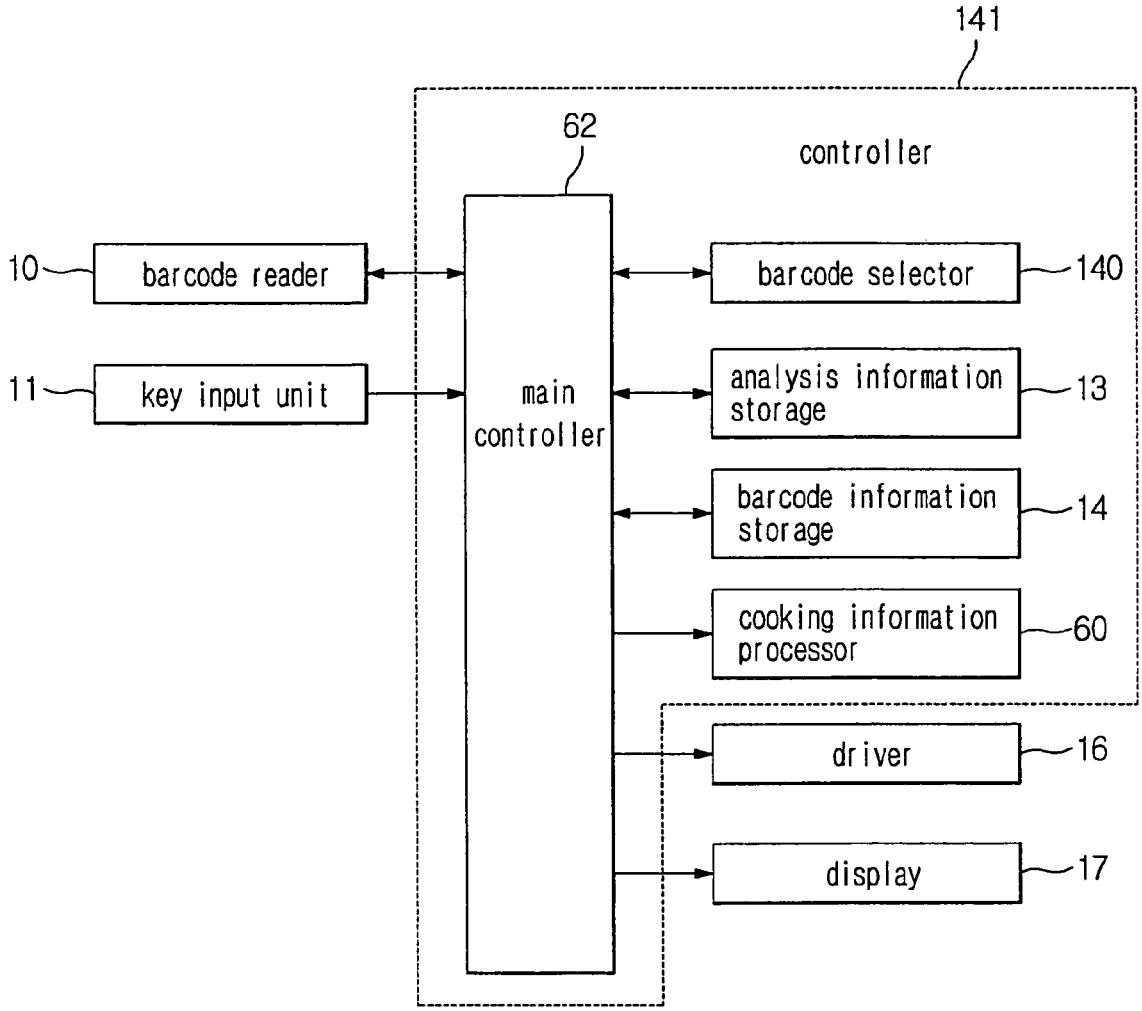
FIG. 12B is a block diagram showing the configuration of another electronic oven according to the third embodiment of the present invention, which includes a controller different from that of FIG. 12A.

In addition to the elements of the electronic oven shown in FIGS. 8A and 8B, the electronic oven according to third embodiment of the present invention further includes a barcode selector 140, as shown in FIGS. 12A and 12B, which checks and selects a barcode, suitable for the electronic oven to perform cooking, from a plurality of barcodes. The barcode selector 140 may be provided in a controller 141 as shown in FIG. 12B, and also may be embedded in a barcode reader 10. The other elements shown in FIGS. 12A and 12B are substantially the same as those shown in FIGS. 8A and 8B, and further description thereof will thus be omitted.

Figure 13:
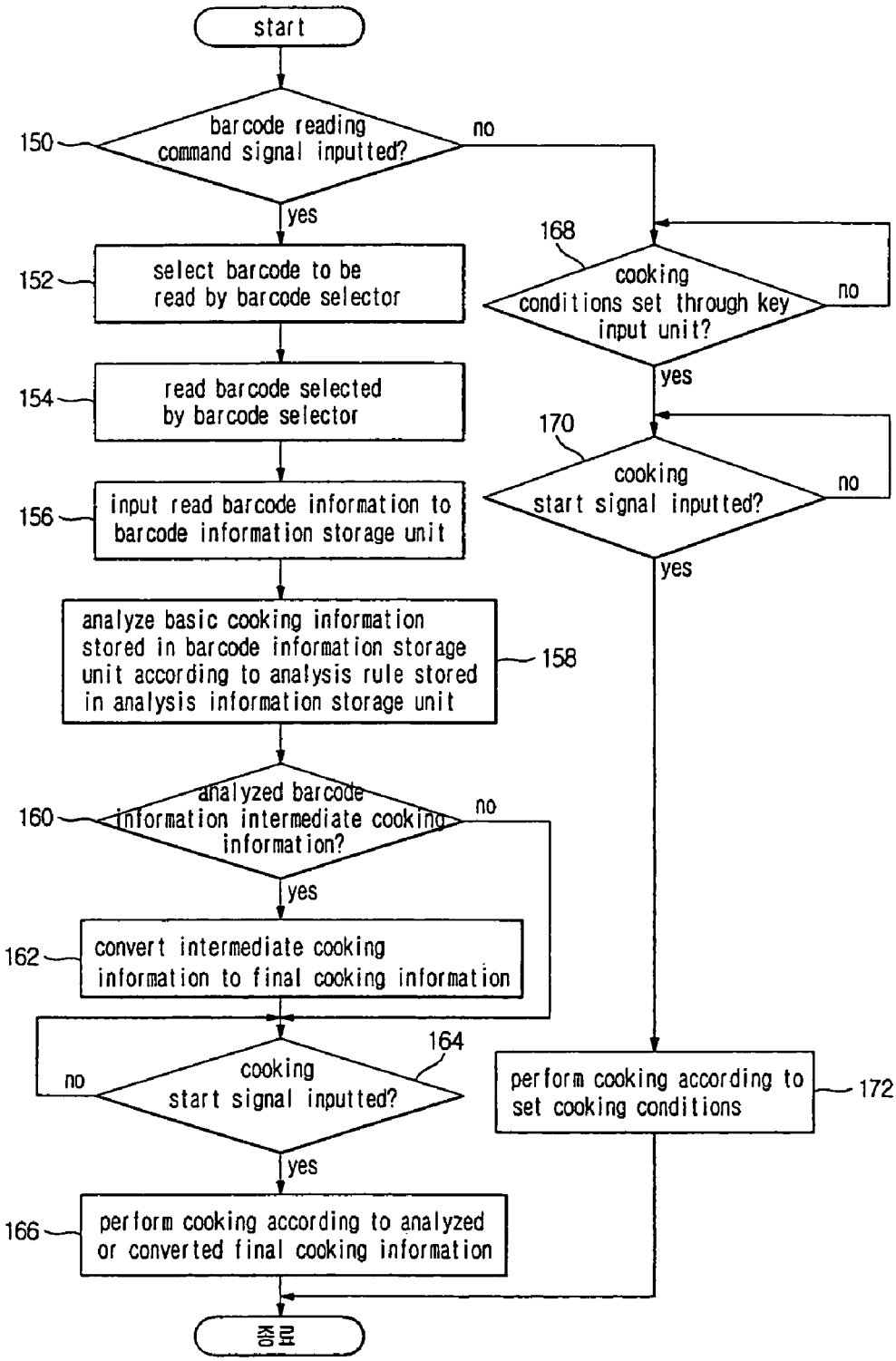
FIG. 13 is a flow chart showing a method for operating the electronic oven shown in FIGS. 12A and 12B.

A description will now be given of how the electronic oven according to the third embodiment operates to perform cooking, with reference to FIG. 13. The operation of the electronic oven according to the third embodiment is mostly the same as the operation of the electronic oven according to the second embodiment. However, the third embodiment differs from the second embodiment in that the barcode selector 140 selects a barcode for reading from among a plurality of barcodes 131, 132, 133, and 134 at step 152 after a command signal to read barcodes has been input.

There are a number of methods for selecting one of the plurality of barcodes 131, 132, 133, and 134. The third embodiment employs a barcode selection method in which barcode selection information is additionally recorded in a specific bar of each of the barcodes. In this method, for example, barcode selection information for a 20 L cooking chamber capacity of the electronic oven is defined as "00", and barcode selection information for a 30 L cooking chamber capacity is defined as "01". Two barcodes are printed on a package, where the first barcode includes barcode selection information "00", and the second includes barcode selection information of "01". If the package with the two barcodes printed thereon is brought near a barcode reader provided to an electronic oven having a 20 L cooking chamber capacity, a barcode selector 141 of the electronic oven recognizes the barcode selection information "00" to read only the first barcode.

Alternatively, the barcode selector 140 may be combined into the electronic oven as shown in FIGS. 4A and 4B. If the barcode selector 140 is combined into the electronic oven as shown in FIGS. 4A and 4B, the method for operating the electronic oven as shown in FIG. 5 further includes the step of selecting a barcode to be read by the barcode reader.

As is apparent from the above description, a cooking apparatus using barcodes according to the present invention has the following advantages. First, there is no need to record complete cooking information for each cooking stage in the barcodes.

It is thus possible to reduce the size of cooking information recorded in the barcodes.

It is also possible to automatically select a barcode suitable for the cooking apparatus from a plurality of barcodes in which different cooking conditions are recorded and then to set cooking conditions based on barcode information recorded in the selected barcode.

Although a few embodiments of the present invention have been shown and described, the present invention is not limited to the described embodiments. Instead, it would be appreciated by those skilled in the art that changes may be made in these embodiments without departing from the principles and spirit of the invention, the scope of which is defined by the claims and their equivalents.

What is claimed is:

1. A cooking apparatus using barcodes, comprising:

a barcode reader which reads a barcode including cooking information recorded in the barcode;

a cooking information calculator which analyzes the basic cooking information based on an analysis rule for analyzing the cooking information and calculating a final cooking condition based on the analyzed cooking information; and a controller which controls elements of the cooking apparatus to perform cooking according to the final cooking condition, wherein the cooking information calculator includes an analysis information storage unit having an analysis rule of cooking information of a plurality of cooking stages, and includes an analysis rule of an N-th stage cooking factor, said N-th stage cooking factor representing an N-th stage cooking condition by the ratio of the N-th stage cooking condition to a first stage cooking condition.

2. The apparatus according to claim 1 wherein the cooking information calculator calculates the N-th stage cooking condition by multiplying the first stage cooking condition by the N-th stage cooking factor.

3. The apparatus according to claim 2, wherein the N-th stage cooking condition is an N-th stage cooking time and the N-th stage cooking factor is an N-th stage time factor.

4. The apparatus according to claim 2, wherein the N-th stage cooking condition is an N-th stage temperature and the N-th stage cooking factor is an N-th stage time factor.

5. The apparatus according to claim 1, wherein the cooking information is at least one of a cooking time, a cooking method, the number of stages, a stage time factor, a power level, a turn over mode, and a convection temperature.

6. The apparatus according to claim 1, wherein the cooking time of a stage other than the first stage is represented by one of the ratio and a functional relationship of the cooking time of the stage to the first stage cooking time.

7. The apparatus according to claim 1, wherein N is a natural number greater then 1.

8. A cooking apparatus using barcodes, comprising:

a barcode reader which reads a barcode including cooking information recorded in the barcode;

a controller which analyzes the cooking information based on an analysis rule and which obtains a final cooking condition based on the analyzed cooking information; and a driver which performs cooking so as to achieve the final cooking condition, wherein the controller includes an analysis information storage unit having an analysis rule of cooking information of a plurality of cooking stages, and includes an analysis rule of an N-th stage cooking factor, said N-th stage cooking factor representing an N-th stage cooking condition by the ratio of the N-th stage cooking condition condition to a first stage cooking condition.

9. The apparatus according to claim 8, wherein the controller further comprises a cooking information calculator including an analysis information storage unit.

10. The apparatus according to claim 8, wherein N is a natural number greater than 1.

11. A cooking apparatus using barcodes, comprising:

a barcode reader which reads a barcode including barcode information recorded in the barcode;

a cooking information processor which analyzes the barcode information based on an analysis rule for analyzing barcode information, calculates final cooking information based on the data to be inputted by a user when the analyzed barcode information is intermediate cooking information, and maintains the analyzed barcode information when the analyzed barcode information is final cooking information; and a controller which controls elements of the cooking apparatus to perform cooking so as to achieve a state corresponding to the final cooking information, wherein the cooking information processor includes an analysis information storage unit having an analysis rule of cooking information of a plurality of cooking stages, and includes an analysis rule of an N-th stage cooking factor, said N-th stage cooking factor representing an N-th stage cooking condition by the ratio of the N-th stage cooking condition to a first stage cooking condition.

12. The apparatus according to claim 11, wherein N is a natural number greater than 1.

13. A cooking apparatus using barcodes, comprising:

a barcode reader which reads a barcode including barcode information recorded in the barcode;

a controller which analyzes the barcode information based on an analysis rule for analyzing barcode information, calculates final cooking information based on the analyzed barcode information when the analyzed barcode information is intermediate cooking information, and maintains the analyzed barcode information when the analyzed barcode information is final cooking information; and a driver which controls elements of the apparatus to perform cooking so a to achieve a state corresponding to the final cooking information, wherein the controller includes an analysis information storage unit having an analysis rule of cooking information of a plurality of cooking stages, and includes an analysis rule of an N-th stage cooking factor, said N-th stage cooking factor representing an N-th stage cooking condition by the ratio of the N-th stage cooking condition to a first stage cooking condition.

14. The apparatus according to claim 13, wherein the controller further comprises a cooking information processor including an analysis information storage unit.

15. The apparatus according to claim 13, wherein N is a natural number greater than 1.

* * * * *

UNITED STATES PATENT AND TRADEMARK OFFICE

CERTIFICATE OF CORRECTION

PATENT NO. : 7,361,866 B2
APPLICATION NO. : 10/872440
DATED : April 22, 2008
INVENTOR(S) : Yun-Bong Chun It is certified that error appears in the above-identified patent and that said Letters Patent is hereby corrected as shown below:

On the title page, item [56]: Column 2 (Other Publications), Line 1, change "Kim." to --Kim, Samsung Electronics Co., Ltd.--.

Column 14, Line 66, after "claim 1" insert --,--.

Column 15, Line 19, change "then" to --than--.

Column 15, Line 35, before "to a first" delete "condition".

Column 16, Line 31, after "cooking so" change "a" to --as--.

Signed and Sealed this

Seventh Day of October, 2008

JON W. DUDAS
*Director of the United States Patent and Trademark Office*